United States Patent [19]

Schadler

[11] Patent Number: 4,899,165

[45] Date of Patent: Feb. 6, 1990

[54] VARIABLE CIRCULAR POLARIZATION ANTENNA HAVING PARASITIC Z-SHAPED DIPOLE

[75] Inventor: John L. Schadler, Lindelwold, N.J.

[73] Assignee: General Signal Corporation, Stamford, Conn.

[21] Appl. No.: 261,049

[22] Filed: Oct. 20, 1988

[51] Int. Cl.[4] ..... H01Q 13/12; H01Q 11/14

[52] U.S. Cl. ..... 343/767; 343/727; 343/770; 343/890

[58] Field of Search ..... 343/767, 770, 771, 890, 343/891, 833, 806, 727, 730

[56] References Cited

U.S. PATENT DOCUMENTS

| | | | |
|---|---|---|---|
| 4,119,970 | 10/1978 | Bogner et al. | 343/770 |
| 4,129,871 | 12/1978 | Johns | 343/771 |
| 4,223,315 | 9/1980 | Alford | 343/890 |

*Primary Examiner*—Rolf Hille
*Assistant Examiner*—Michael C. Wimer
*Attorney, Agent, or Firm*—Robert R. Hubbard; John F. Ohlandt

[57] ABSTRACT

A specially designed, Z-shaped, parasitic dipole is spaced radially outwardly from the slot provided in a cylindrical antenna; a controlled amount of energy which is in a horizontally polarized direction is coupled to the Z-shaped dipole so as to radiate energy into the vertical plane, thus creating a variable circularly polarized antenna capable of adding a selectable amount of vertical component to the horizontal in quadrature; since the dipole element, which parasitically develops its polarized energy, is in the same horizontal plane as the polarized energy emanating from the slot, a good, i.e. constant, axial ratio is maintained throughout the elevation pattern.

7 Claims, 3 Drawing Sheets

VARIABLE CIRCULAR POLARIZATION ANTENNA HAVING PARASITIC Z-SHAPED DIPOLE

BACKGROUND OF THE INVENTION

This invention relates to circularly polarized antennas and, more particularly, to such antennas which include a conductive cylinder having a slot for purposes of achieving horizontally polarized radiation.

In the recent past, there have been significant developments that have led to circularly polarized broadcasting, which has been found to improve television reception in large metropolitan areas. However, up until the present time, circular polarization has been exploited only in connection with VHF television broadcasting because current innovative antenna designing has occurred in, and been limited to, that region of the spectrum.

One of the advantages of circular polarization has been the elimination of reception problem areas because almost any desired pattern can be achieved, either omni-directional or selectively directional depending on the desired area of coverage. Further advantages are a reduction in ghosting, better isolation between closely channeled antennas, and a more solid reception coverage since the reception is independent of the receiving antenna's orientation.

At the present stage of development of antennas, however, circular polarization has not been extended to the UHF channels.

Accordingly, a primary object of the present invention is to achieve the extension of circular polarization in an efficient and relatively inexpensive manner to the UHF channels as well as VHF.

It is well known that a slot cut in a waveguide wall, whether the guide be coaxial, rectangular, or circular, will radiate energy into space in the plane perpendicular to that of the slot's long dimension. In broadcast antenna applications, the slots are positioned vertically on a cylindrical pylon antenna to emanate a horizontally polarized signal. An example of a slotted antenna producing a horizontally polarized signal is that described by Bazen in U.S. Pat. No. 2,981,987.

Accordingly, another primary object of the present invention is to provide a means of converting the type of antenna exemplified by the Bazen patent so as to enable circularly polarized radiation.

Attempts have been made to convert slotted antennas of the type disclosed in Bazen, and an example of a circularly polarized antenna of this type may be appreciated by reference to U.S. Pat. No. 4,129,871 to Mckinley R. Johns.

In the Johns patent, a circularly polarized antenna is provided using a slotted conductive mast. The slots extend about one half wavelength long along the lengthwise axis of the mast for exciting horizontal components of the wave. A pair of conductive rods extend from respective affixation points closely adjacent each elongated side of an individual slot, each rod being about one full wavelength long and having a free end portion extending in the vertical plane approximately one half wavelength to radiate the vertical component of the wave.

As noted by the patentee in U.S. Pat. No. 4,129,871, each of the conductive rods disclosed therein is considered an end fed, full wave radiator. This contrasts with the dipole of the antenna system of the present invention which, rather than being end fed, parasitically develops the required polarized energy, such dipole—or at least a portion thereof—being in the same horizontal plane as the polarized energy emanating from the slot formed in the cylindrical mast of the system. Therefore, the dipole incorporated in the antenna system of the present invention is termed a parasitic dipole because of the manner of its coupling to the horizontally polarized energy.

It is another object of the present invention to maintain a good, i.e., constant axial ratio throughout the elevation pattern of radiation from the antenna.

Previously known designs of slot driven antenna systems, such as those involving interlaced slots and dipole elements, have led to unacceptably high axial ratios with increased depression angle. Infinite axial ratios and left-handed polarization can result. Consequently the location of in-home "rabbit ear" antennas becomes critical since positions can be found where the received signal goes to zero. In contrast, the design in accordance with the present invention ensures that phase quadrature and good axial ratio will be maintained with increased depression angle.

SUMMARY OF THE INVENTION

Briefly stated, a circularly polarized antenna system is provided, said system comprising: a conductive cylindrical mast having a slot extending axially at the outer periphery of the mast; means for feeding said slot for exciting horizontally polarized waves; a parasitic Z-shaped dipole spaced radially outwardly from said slot, and in the same horizontal plane as the horizontally polarized waves from said slot, for exciting vertically polarized waves in phase quadrature with said horizontally polarized waves; and means for affixing said parasitic Z-shaped dipole to said mast as spaced points thereon.

It will be appreciated that the antenna construction to be described achieves a circularly polarized system, but utilizes the same basic hardware as the standard horizontally polarized UHF pylon antenna, such as a slotted outer pipe or mast, and the internal coupling and feed design involves the same radome considerations. When the vertical radiating element, that is, the slot-driven parasitic dipole, is solidly grounded to the mast in spaced relationship therewith, the antenna becomes circularly polarized. The construction is extremely simple, sturdy, and is lightening protected.

Other and further objects, advantages and features of the present invention will be understood by reference to the following specification in conjunction with the annexed drawing, wherein like parts have been given like numbers.

DESCRIPTION OF PREFERRED EMBODIMENT

Figure 1:
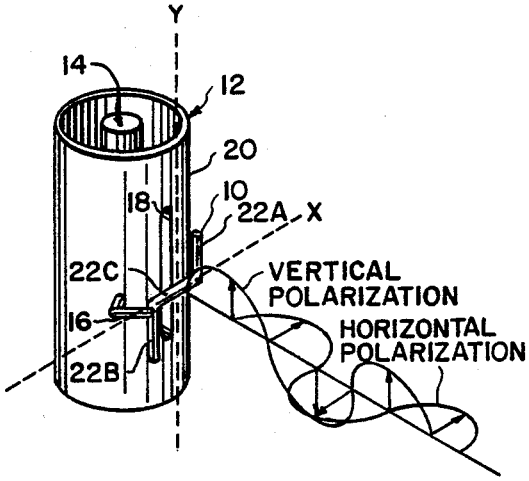
FIG. 1 is a perspective view of an antenna system in accordance with a preferred embodiment of the present invention, the launching of waves in both the horizontally polarized direction and the vertically polarized being seen therein.
Figure 2:
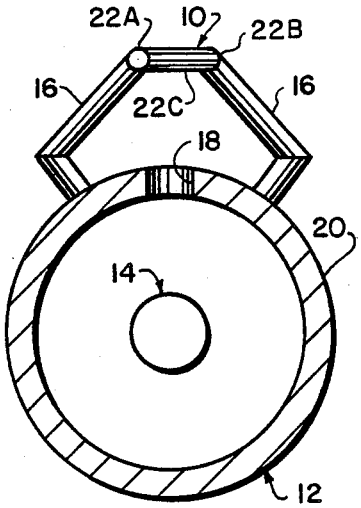
FIG. 2 is an end view of the antenna system of FIG. 1.

Referring now to the figures of the drawing, and for the moment to FIG. 1, there is seen in that figure the radiation launching from an antenna system in accordance with the preferred embodiment of the present invention. The launching of waves in both the horizontally polarized direction and the vertically polarized direction will be seen. In particular, the vertical polarization is at 90 degrees or is in phase quadrature with the horizontal polarization.

As will be understood from what has been discussed previously, the phase quadrature relationship between horizontal and vertical polarization is produced by selectively spacing the Z-shaped dipole antenna 10 from the conductive cylindrical mast 12. The antenna system as seen comprises the outer mast 12 and the inner conductor 14, which together constitute a coaxial transmission line.

The dipole 10 is affixed to the cylindrical mast 12, preferably by grounding supports 16 suitably attached thereto, although insulative supports can be utilized instead to provide a "floating" dipole. The dipole 10 is radially outwardly spaced from a slot 18 extending axially at the outer periphery 20 of the mast.

It will be noted that the Z-shaped dipole 10 includes two free-end portions 22A and 22B extending in opposite directions, both extending axially in a plane parallel to the longitudinal dimension of slot 18. A third transverse portion 22C connects to both of the other, adjacent, ends of portions 22A and 22B to provide the Z configuration.

In an exemplary construction of a physical embodiment which is capable of providing the aforenoted phase quadrature, the following parameters obtained: Slot 18—7 inches long × 1 inch wide; spacing of dipole 10 from mast 12—2¼ inches; frequency—803 MHz; mast diameter—7 inches. It should be noted that this phase difference is dependent only on the dipole spacing from the slot. However, it will be understood that the amount of spacing required in a given situation varies with the particular parameters that obtain.

When the phase difference is set to 90 degrees, the signal level being radiated will remain between the horizontal and vertical radiation components regardless of the receiving antenna's orientation. Thus, an excellent axial ratio is created in the horizontal plane which is independent of the amount of vertical coupling. This concept is illustrated in FIGS. 3 and 4.

Figure 3:
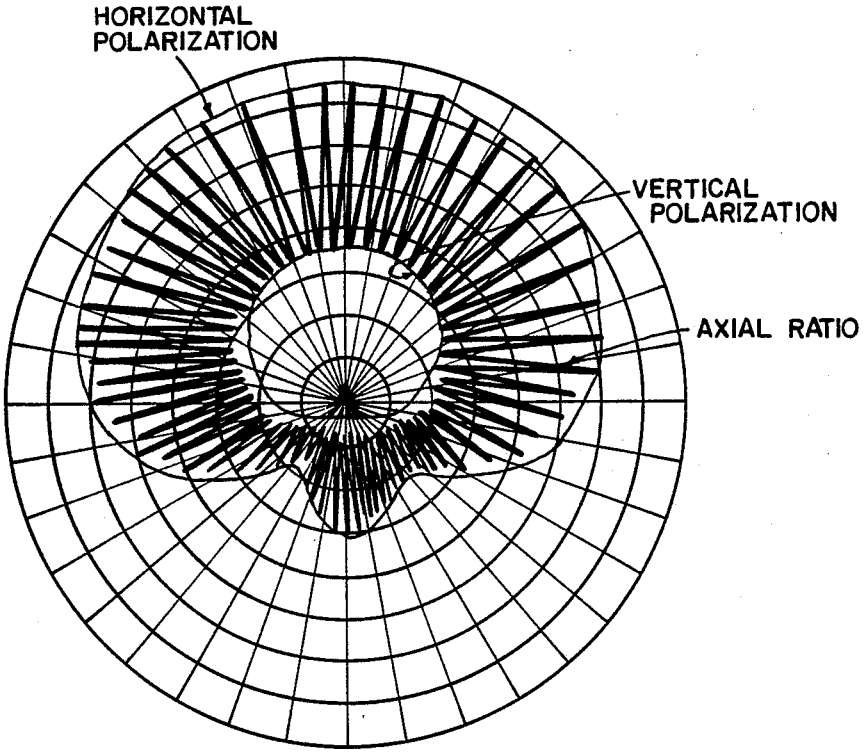
FIG. 3 is a measured pattern of partial circular polarization due to a relatively short length for the Z-shaped dipole, illustrating particularly what is termed a skull pattern or configuration.
Figure 4:
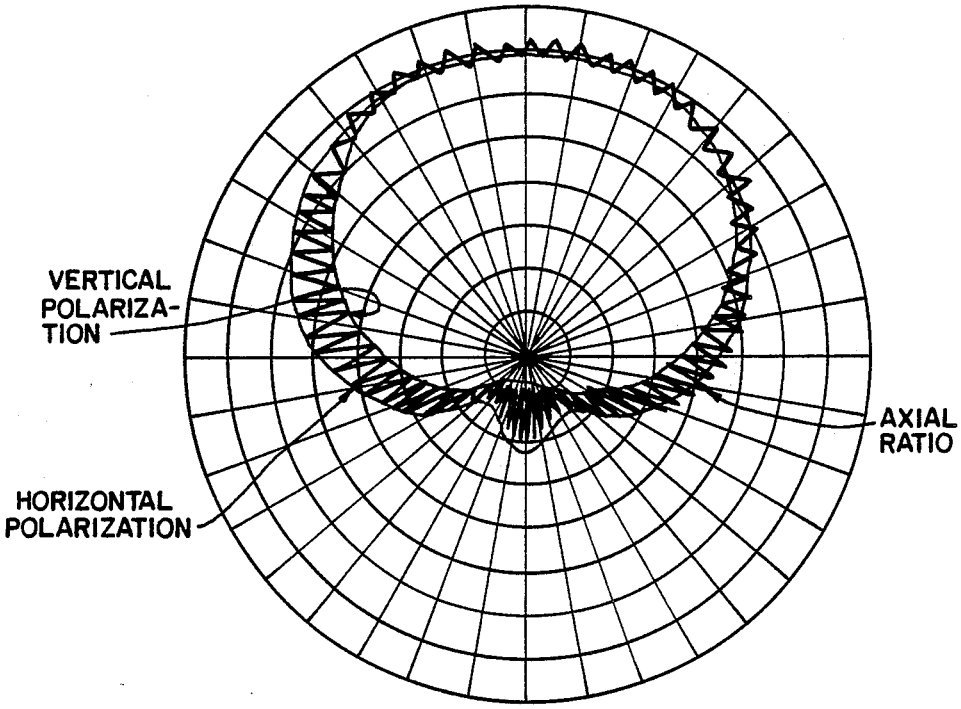
FIG. 4 is another measured pattern of polarized radiation, but with substantially full circular polarization, again illustrating what is termed a skull configuration resulting from the preferred antenna embodiment illustrated in FIG. 1.

In FIG. 3, a partial circular polarization is obtained as shown by the measured pattern. The amount of coupling or power division between the slot 18 and the slot-driven Z-shaped dipole between the horizontal and vertical radiation components, is directly dependent on the dipole length. In FIG. 3, the dipole length, which is the total distance from the one free end of the dipole along each of the portions 22A, 22C, and 22B is 4.5 inches. In the case of FIG. 4, this total distance is 6 inches.

Figure 5:
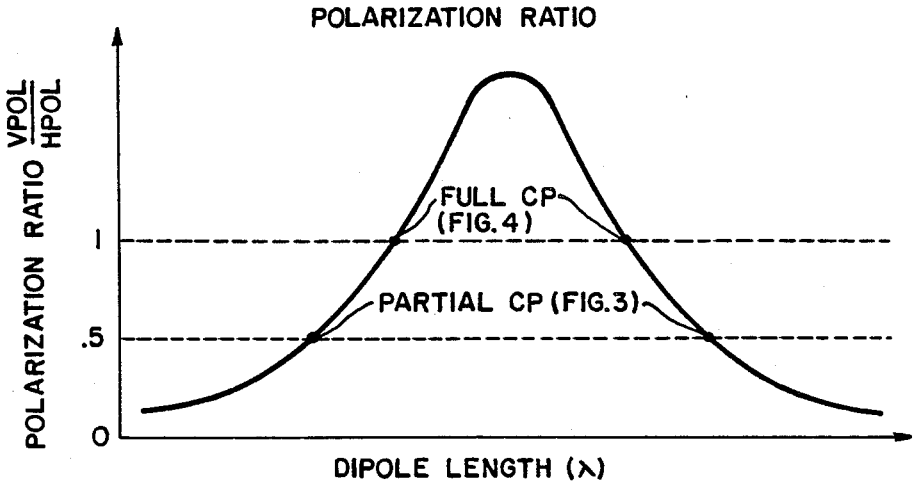
FIG. 5 is a plot of the polarization ratio, that is, the ratio between the horizontal and vertical radiation components versus dipole length.

The dependence of the polarization ratio on the dipole length is illustrated in FIG. 5, where the Z dipole length is measured in wavelengths and the polarization ratio is the vertical component (VPOL) divided by the horizontal (HPOL).

Figure 6:
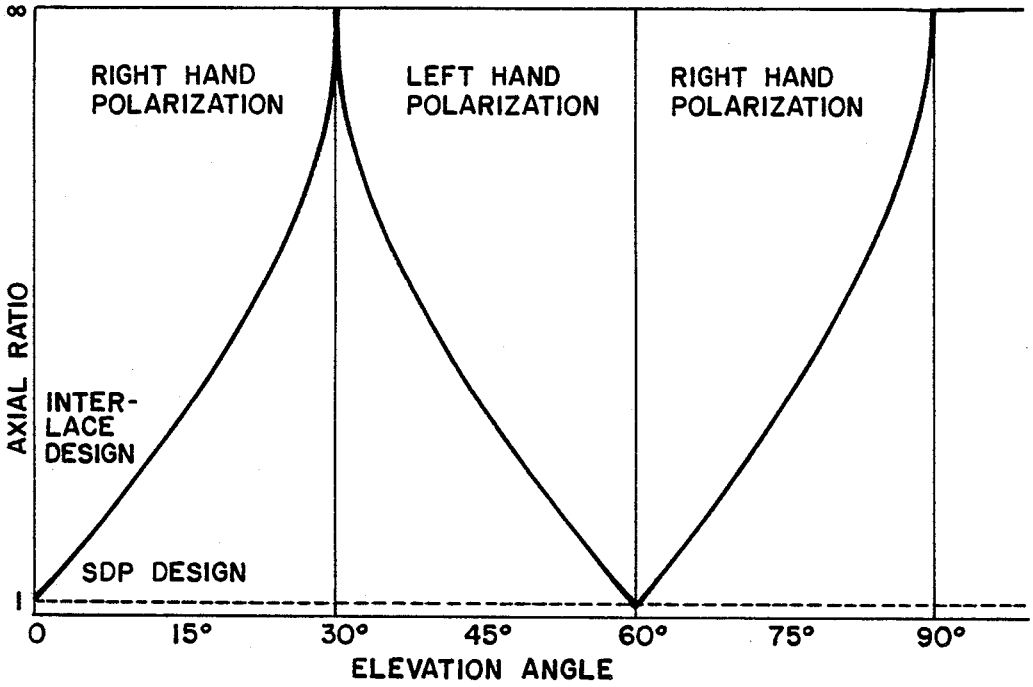
FIG. 6 is a plot of axial ratio versus elevation angle in the case of the design in accordance with the present invention and also in accordance with a so-called interlace design.

Referring now to FIG. 6 of the drawing, it will be understood that the axial ratio, which is utilized in antenna design, is the quantity which describes the merit of operation for circularly and elliptically polarized antennas. Since the dipole 10 of the present invention is slot-driven and is in the same horizontal plane as the horizontal component of radiation from the slot, a constant axial ratio is maintained in the elevation pattern throughout the null structure. Thus, as seen in FIG. 6, the theoretical axial ratio for the antenna system of the present invention is shown as a dotted line having a constant value of 1. On the other hand, for a typical interface design for antenna systems, involving interlaced slot and dipole radiators, there is severe deterioration for the axial ratio along the depression angle. This is due to the space phase between adjacent radiating elements.

FIG. 6 clearly shows the rapid deterioration of the axial ratio with increasing elevation angle. In the first five degrees of elevation, the axial ratio worsens by 3 dB. This is the acceptable limit for most practical antenna uses. As the elevation angle increases beyond 5 degrees, the axial ratio soars to infinity. After 30 degrees, the axial ratio begins to decrease, but the sense of rotation of the circularly polarized wave has reversed. This is unacceptable to the television broadcast industry since the FCC restricts the transmitted television signals to right-hand polarization. This rising and falling axial ratio, as well as polarization reversal, occurs every 30 degree cycle throughout the elevation pattern.

Figure 7:
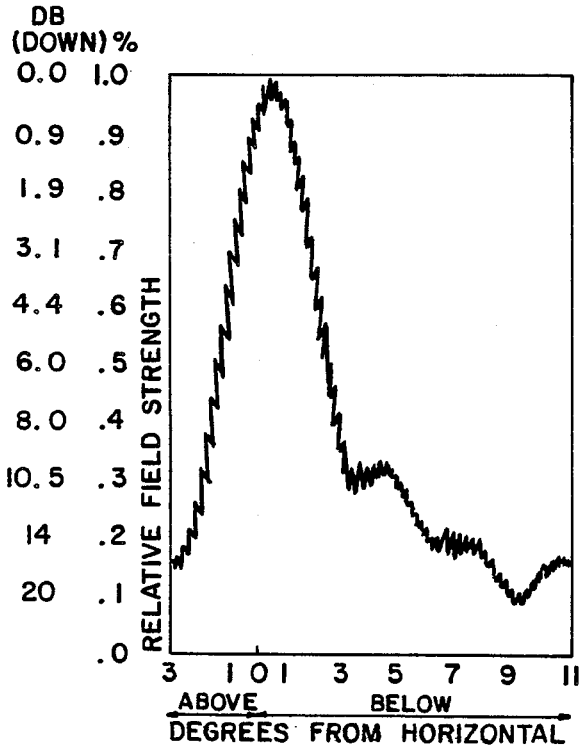
FIG. 7 is a measured radiation pattern, particularly involving plotting the elevation angle, above and below the horizon, versus relative field strength, and providing an indication of the substantially constant axial ratio.

Referring now to FIG. 7, a measured pattern of radiation is shown for one example of the circularly polarized antenna system in accordance with the present invention. This pattern contrasts slightly with the theoretical illustration of FIG. 6 in which a constant value of 1 for the axial ratio was shown for the present system.

The plotting in FIG. 7 is of the measured relative field strength in DB and in percentage, versus degrees from the horizontal. The important aspect of FIG. 7 is that despite the significant variation in the field strength of the antenna system as measured with respect to the horizontal, the axial ratio, which is in the form of the spikes or serrations, is substantially constant throughout the plot.

It will now be completely apparent that the antenna system design of the present invention has a number of advantages over the systems of the prior art; particularly in respect to obtaining extremely good axial ratio in the elevation pattern. Furthermore, the antenna system can be factory adjusted for any amount of vertical component and still maintain nearly 90 degrees phase quadrature between polarizations. The actual measured axial ratio establishes that the phase quadrature relationship will be maintained, unlike other systems where such relationship significantly deteriorates and causes reception problems.

It will also have become apparent that a grounded parasitic dipole of the invention can couple a controlled percentage of energy from the antenna slot and radiate it into a vertical plane, thereby converting a more or less standard UHF antenna design into a variable circularly polarized antenna system.

It will be appreciated that, although a single preferred embodiment for the antenna system of the present invention has been illustrated, and hence only a restricted number of measured radiation patterns have been presented, as per FIGS. 3 and 4, a variety of other desired radiation patterns can be achieved following the essential principle of the present invention. For example, rather than the antenna configuration seen in FIG. 1, namely a single slotted coaxial antenna, a double slotted model with fins can be provided. Such modified antenna configuration will produce a so-called "bent peanut" pattern. In such a variation or modification, the Z-shaped dipoles, as shown in FIG. 1, may be radially placed from both of the slots of such modification and they may be left floating or grounded, as desired.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

I claim:

1. A circularly polarized antenna system comprising:

a conductive cylindrical mast having a slot extending axially at the outer periphery of the mast;

means for feeding said slot for exciting horizontally polarized waves;

a parasitic Z-shaped dipole spaced radially outwardly from said slot, and in the same horizontal plane as the horizontally polarized waves from said slot, for exciting vertically polarized waves in phase quadrature with said horizontally polarized waves;

said Z-shaped dipole having a center portion which couples across said slot, thereby parasitically coupling said slot to said dipole; and means for affixing said parasitic Z-shaped dipole to said mast at circumferentially spaced points thereon remote from said slot.

2. The combination as defined in claim 1, in which said Z-shaped dipole includes at least two free-end portions, both extending axially in a plane parallel to the longitudinal dimension of said slot, and a third portion connecting said first and second portions and extending perpendicularly to said longitudinal dimension of the slot.

3. The combination as defined in claim 1, in which said means for feeding said slot includes a center conductor coaxial with and extending inside said conductive cylindrical mast.

4. The combination as defined in claim 1, in which said means for affixing includes supports for grounding said Z-shaped dipole to said mast.

5. The combination as defined in claim 1, in which the quadrature phasing in determined by locating said Z-shaped dipole an appropriate radial distance from said slot.

6. The combination as defined in claim 1, in which the polarization ratio between the horizontally polarized component and the vertically polarized component varies with the length of said Z-shaped dipole.

7. The combination as defined in claim 1, in which the axial ratio remains substantially constant as a function of the elevation angle of the energy being radiation from said antenna system.

* * * * *